United States Patent [19]

Gentiluomo

[11] 4,347,767

[45] Sep. 7, 1982

[54] RATCHETING DEVICE

[76] Inventor: Joseph A. Gentiluomo, 1456 Belmont Ave., Schenectady, N.Y. 12308

[21] Appl. No.: 222,780

[22] Filed: Jan. 6, 1981

[51] Int. Cl.[3] ..... B25B 13/46

[52] U.S. Cl. ..... 81/62; 192/43.1; 192/93 B

[58] Field of Search ..... 81/62, 63; 192/43.1, 192/93 B

[56] References Cited

U.S. PATENT DOCUMENTS 3,532,013 10/1970 Haznar ..... 81/62

4,211,127 7/1980 D'Oporto et al. ..... 81/63

4,280,379 7/1981 Chow ..... 81/62

*Primary Examiner*—James L. Jones, Jr.

[57] ABSTRACT

This invention pertains to ratchet mechanisms, and has particular application to ratchet wrenches of the type employing removable sockets for engagement with a stud having a ball detent for holding the sockets thereto during wrench operation. The novelty of the invention resides in the use of a push-button selector for alternately effecting the reversing action of the ratchet mechanism in conjunction with a push-button device for releasing the sockets from the stud.

8 Claims, 4 Drawing Figures

RATCHETING DEVICE

This invention relates to the art of ratchet mechanisms which have particular application to ratchet wrenches. Presently available ratchet wrenches incorporate a selector knob which is rotated either clockwise or counterclockwise for selecting the direction of ratcheting action. It has been observed that in order to change the direction of ratcheting action in most commercially available ratchet wrenches, two hands are required. One design requires the user to hold the driven member stationary with one hand, while the selector knob is rotated with the other hand. If said driven member is not held stationary, said selector knob will simply rotate said driven member without changing the direction of ratcheting action. In the other design, the ratcheting action can be changed without holding the driven member stationary, however, two hands must be used. One hand must be used to hold the wrench handle, and the other hand to rotate the selector knob. One hand generally cannot be used to simultaneously hold the wrench handle and rotate the selector knob, especially when the users hand is greasy. For example, if the wrench were used in close quarters where access to said selector knob were not available, said wrench would have to be withdrawn in order to change the wrench's ratcheting direction. Even so, changing of the ratcheting direction would prove difficult for a handicapped person having the use of only one hand, because said person would not be able to hold the wrench and simultaneously provide rotation to said selector knob.

Due to the above cited disadvantages, the instant invention was conceived to provide a ratchet wrench whereby only one hand is required for holding said wrench by the handle and simultaneously depressing the push-button with the thumb for alternate reversing the direction of ratchet drive.

Therefore, it becomes apparent that objects of this invention are as follows:

To provide a ratcheting mechanism wherein the direction of ratcheting action can be alternately changed by means of push-button control.

To provide a ratchet wrench having push-button means for socket release.

To provide a ratchet wrench that can be more readily used by handicapped persons having use of only one hand.

To provide a ratchet wrench wherein the direction of ratcheting action can be more readily changed while in close quarters, than presently available ratchet wrenches.

These objects and other objects of this invention should be discerned and appreciated from the description and claims taken in conjunction with the accompanying drawings in which:

Figure 1:
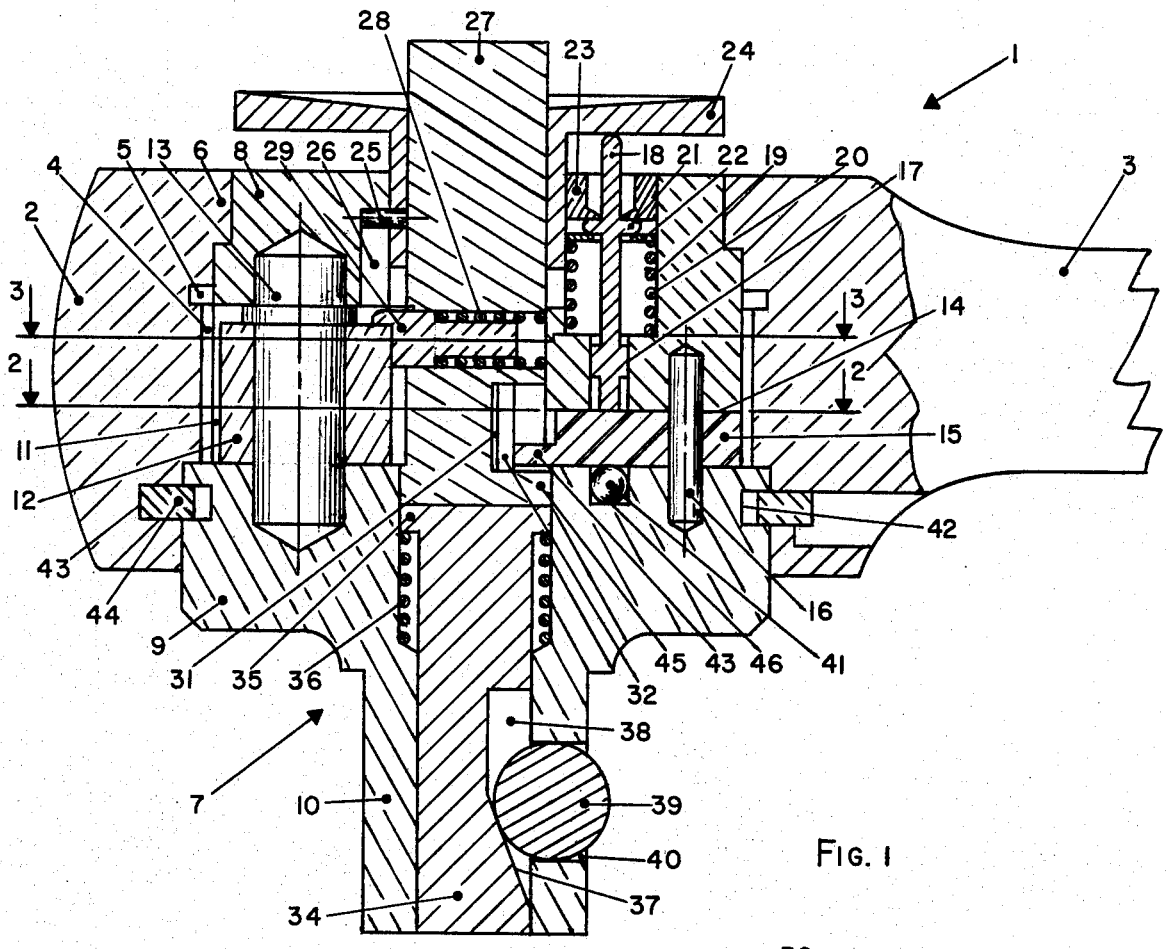
FIG. 1 is a sectional side view of the ratcheting device.
Figure 2:
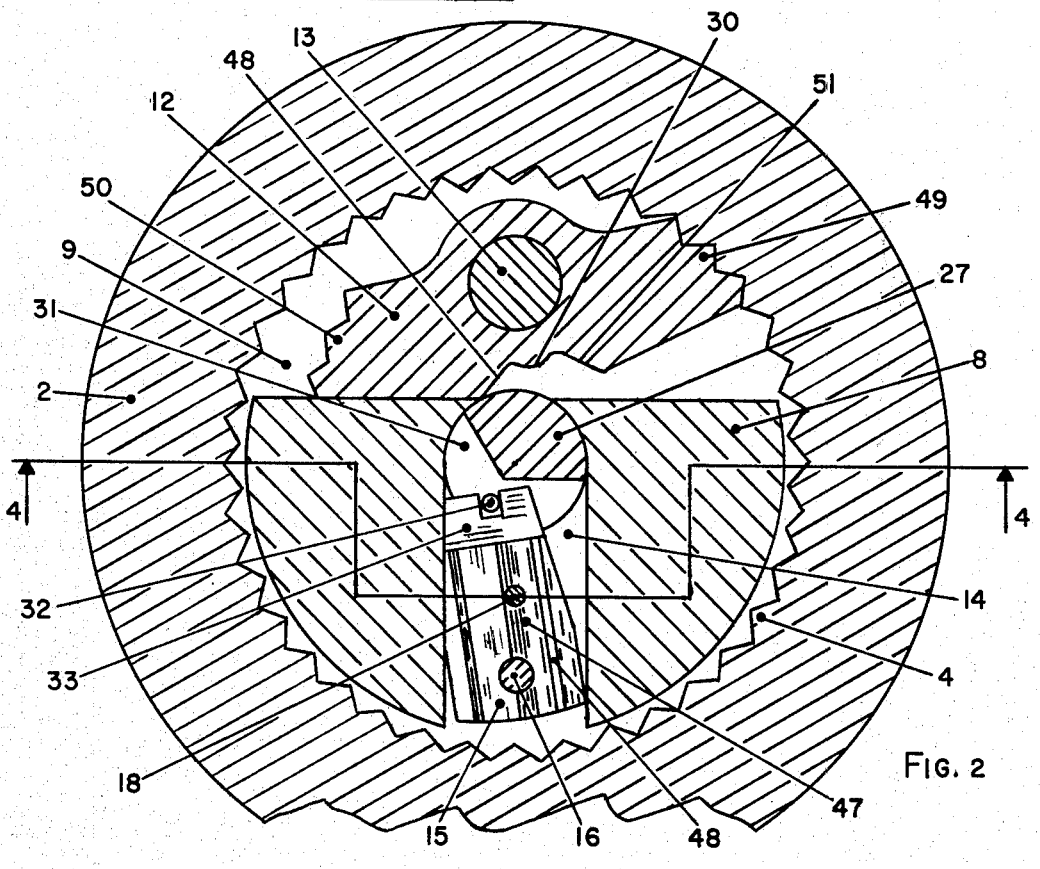
FIG. 2 is a sectional view taken along 2—2 of FIG. 1.
Figure 3:
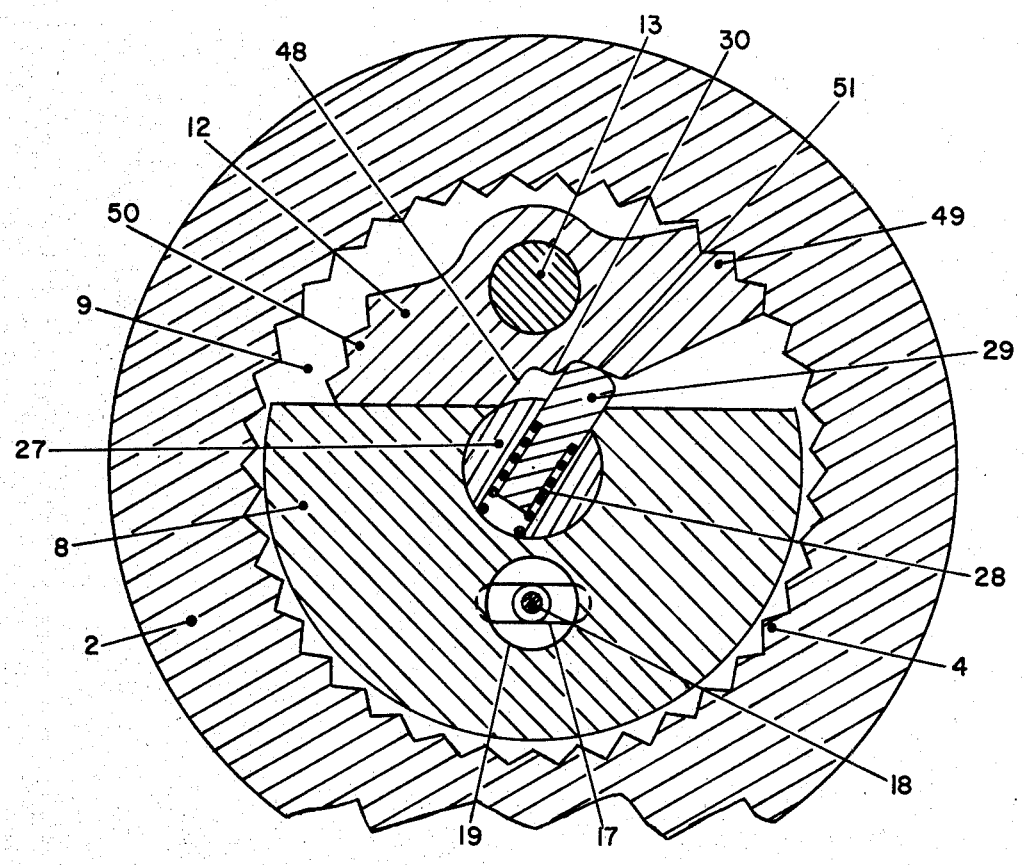
FIG. 3 is a sectional view taken along 3—3 of FIG. 1.
Figure 4:
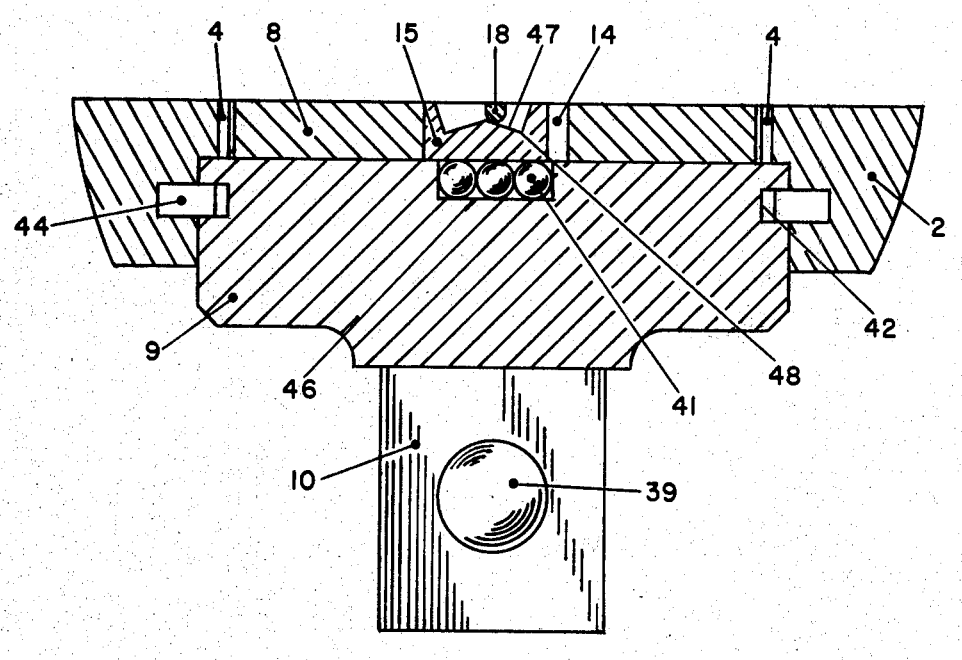
FIG. 4 is a sectional elevational view taken along 4—4 of FIG. 2.

Referring to FIGS. 1-4 of the drawings, this invention is shown applied to a reversible ratchet wrench comprising a driving member 1 consisting of head 2 and handle 3. Said head 2 includes a flange portion 6, and axially disposed internal teeth 4 located intermediate annular groove 5 and annular groove 43.

Rotatably mounted within the bore of head 2 is the driven member 7, consisting of upper body member 8 and lower body member 9. Socket engaging stud 10 of said driven member 7 extends from the bottom side of lower body member 9, and carries the yieldable detent ball 39 projecting from one face of said stud 10. Said body member 8 includes a segmental side recess 11 for accommodating a double ended sector pawl 12 to selectively engage the internal teeth 4 of said head 2. Said sector pawl 12 has teeth such as 49 and 50 disposed at each end. Intermediate said teeth is pawl pin 13 for pivotal mounting of said sector pawl 12 between upper body member 8 and lower body member 9. Diametrically opposite to said recess 11, is a radial shifter bar slot 14 for containing pivotally mounted shifter bar 15 between upper body member 8 and lower body member 9 by means of shifter bar pin 16. Above said slot 14, is transverse plunger slot 17 for guiding plunger 18 therewithin. Above said slot 17, is cavity 19 containing spring 20. Intermediate spring 20 and collar 21, is split washer 22. Said plunger 18, split washer 22, and spring 20, are retained within said cavity 19 by press fitted cap 23.

Axially and slidably mounted within upper body member 8, is push-button 24. Said push-button is retained within said upper body member 8 by means of stop pin 25 which is confined within longitudinal slot 26. Coaxially and slidably mounted within the central bore of said push-button 24, is upper actuating rod 27. Said upper actuating rod 27 has a transverse hole for containing spring 28 for urging pawl detent 29 outwardly to engage inner surfaces 48 and 51, and lobe 30, of said pawl 12. The lower end of said upper actuating rod 27 has journal portion 45, cut-out 31, and longitudinally disposed pin 32 which interacts with yoke 33 of said shifter bar 15. The height of said cut-out 31 is such as to allow sufficient clearance above yoke 33 when said upper actuating rod 27 is depressed.

Lower actuating rod 34 is slidably mounted within a dual diameter central bore extending axially through lower body member 9 and stud 10, of driven member 7. The upper larger bore portion acts as a bearing surface for journal portion 45 and flange journal 35, and as a spring retaining cavity for spring 36. The reduced bore portion extending axially through stud 10 acts as a sliding bearing surface for the main body portion of said actuating rod 34. Opposite balls 39, and within said actuating rod 34, is a longitudinal cutout consisting of inclined portion 37 merging with recess 38. When said lower actuating rod 34 is in the upwardmost position, said inclined portion 37 will be directly opposite ball 39, and said ball 39 will be in its outermost position protruding from a face of said stud 10. Said ball 39 is retained within transverse cavity 40 by staking the external edge of said cavity 40. In alignment with plunger slot 17 and within the upper surface of said lower body member 9, is ball race slot 46 transverse to shifter bar slot 14, for containing a plurality of balls 41. Driven member 7 is held freely rotatable within the central bore of head 2 by end restraints such as flange 6 and retaining ring 44. Said retaining ring 44 is secured within groove 43 located within the lower end of said head 2, and groove 42 located within the upper cylindrical surface of lower body member 9.

With reference to FIGS. 1-4, the ratchet wrench is shown in operative relation for driving in a counterclockwise direction. When push-button 24 is depressed, plunger 18 will move downward compressing spring 20. While in the downward motion, said plunger 18 will move transversely within plunger slot 17 while sliding downward along incline surface 47 of said shifter bar 15. When spherical end of said plunger 18 wedges in corner 48, continued downward movement of said plunger 18 will force the shifter bar 15 to pivot about pin 16 such that yoke 33 moves to the right. During said pivoting action, the bottom surface of said shifter bar 15 rides over balls 41 to reduce inter-surface friction. Engagement of yoke 33 with pin 32 will operate to rotate upper actuating rod 27 counterclockwise. During said counterclockwise rotation, the spring loaded pawl detent 29 moves over lobe 30 to a position in contact with surface 48. As said pawl detent 29 moves past lobe 30, sector pawl 12 will rotate clockwise about pin 13 such that sector teeth 49 disengage from the internal teeth 4 and sector teeth 50 engage said internal teeth 4. With the sector pawl 12 in this new position, the wrench is set for driving in a clockwise direction. It should be noted that said ratchet reversing mechanism is of such construction that every time said push-button is depressed, ratchet drive will reverse in direction.

To allow a socket to disengage from stud 10, upper actuating rod 27 is depressed. In so doing, pawl detent 29 will slide downward along surfaces 48 or 51 without imposing angular movement to sector pawl 12. Also, during said downward movement of actuating rod 27, cut-out 31 will provide proper clearance with respect to yoke 33 to allow journal portion 45 to effectuate a preset downward movement to lower actuating rod 34. During said preset movement, spring 36 is compressed until recess 38 aligns itself opposite to ball 39. With the affect of spring force removed against ball 39, said ball will cease to hold a socket onto said stud 10. Upon release of said upper actuating rod 27, said lower actuating rod 34 will move upward under the influence of spring 36 until inclined portion 37 bears against ball 39 to push it outward for resilient engagement with the inner wall of a conventional socket. The pressure of the ball detent against the socket wall will maintain the socket onto stud 10 until ball pressure is removed.

It should be noted that upper actuating rod 27 or push-button 24 can be separately depressed without affecting the intended function of the other.

Having thusly described the invention, the following is claimed:

1. A ratcheting device comprising:

a drive member having a toothed bore;

a driven member rotatably mounted within said driver member and including a centrally mounted upper actuating member having a transversely mounted pawl detent;

a double ended toothed pawl pivotally mounted within said driven member and positioned such as to interact with said pawl detent and said toothed bore;

and a push-button actuated direction shifting mechanism operatively associated with said upper actuating member to provide reversed rotation thereto for effectuating alternate engagement of the toothed ends of said double ended pawl with said toothed bore, upon successive depression of said push-button.

2. The invention as defined by claim 1, wherein said driven member is further characterized as including a drive stud protruding from said driven member and containing a transversely mounted socket detent for socket retention.

3. The invention as defined by claim 2, wherein said driven member is further characterized as having a lower actuating member coaxial with and adjacent to said upper actuating member and passing through said drive stud, said lower actuating member having an inclined recess adjacent to said socket detent for slidable engagement therewith upon axial movement of said upper actuating member.

4. The invention as defined by claim 3, wherein said driver member is further characterized as consisting of a head, and a handle protuding from said head.

5. The invention as defined by claim 1, wherein said direction shifting mechanism is further characterized as comprising a pivoted shifter bar with means at one end for rotational engagement with said upper actuating member, a contoured surface within said shifter bar, a plunger disposed above said contoured surface, and a push-button disposed to slidably move said plunger into engagement with said contoured surface for alternate angular displacement of said shifter bar.

6. The invention as defined by claim 5, wherein said driven member is further characterized as including a drive stud protruding from said driven member and containing a transversely mounted socket detent for socket retention.

7. The invention as defined by claim 6, wherein said driven member is further characterized as having a lower actuating member coaxial with and adjacent to said upper actuating member and passing through said drive stud, said lower actuating member having an inclined recess adjacent to said socket detent for slidable engagement therewith upon axial movement of said upper actuating member.

8. The invention as defined by claim 7, wherein said driver member is further characterized as consisting of a head, and a handle protruding therefrom.

* * * * *